US010418789B2

(12) United States Patent
Ma et al.

(10) Patent No.: US 10,418,789 B2
(45) Date of Patent: Sep. 17, 2019

(54) SPARK PLUG WITH A SUPPRESSOR THAT IS FORMED AT LOW TEMPERATURE

(71) Applicant: FEDERAL-MOGUL IGNITION LLC, Southfield, MI (US)

(72) Inventors: Shuwei Ma, Ann Arbor, MI (US); Keith Firstenberg, Livonia, MI (US); William J. Walker, Jr., Ann Arbor, MI (US); Michael Saccoccia, Canton, MI (US)

(73) Assignee: Federal-Mogul Ignition LLC, Southfield, MI (US)

( * ) Notice: Subject to any disclaimer, the term of this patent is extended or adjusted under 35 U.S.C. 154(b) by 0 days.

(21) Appl. No.: 15/661,282

(22) Filed: Jul. 27, 2017

(65) Prior Publication Data

US 2018/0034247 A1 Feb. 1, 2018

Related U.S. Application Data

(60) Provisional application No. 62/367,319, filed on Jul. 27, 2016.

(51) Int. Cl.
*H01T 13/41* (2006.01)
*H01T 21/02* (2006.01)

(52) U.S. Cl.
CPC ..... *H01T 13/41* (2013.01); *H01T 21/02* (2013.01)

(58) Field of Classification Search
CPC ..... H01T 13/05; H01T 13/41; H01T 1/16
USPC ..... 313/134
See application file for complete search history.

(56) References Cited

U.S. PATENT DOCUMENTS

| | | | | | |
|---|---|---|---|---|---|
| 2,281,834 | A | | 5/1942 | Dietz | |
| 2,806,971 | A | | 9/1957 | Twells | |
| 3,088,921 | A | | 5/1963 | Heischman | |
| 3,903,453 | A | * | 9/1975 | Nishio | H01T 13/41 313/118 |
| 4,173,731 | A | * | 11/1979 | Takagi | H01T 13/41 252/504 |
| 4,482,475 | A | * | 11/1984 | Sakai | H01T 13/41 252/504 |
| 4,601,848 | A | | 7/1986 | Sakai | |

(Continued)

FOREIGN PATENT DOCUMENTS

EP 0171153 A1 12/1986

OTHER PUBLICATIONS

Maria, Jon-Paul et al., Cold Sintering: Current Status and Prospects, J. Mater. Res., vol. 34, No. 17, p. 3205-3218 (Sep. 14, 2017).

*Primary Examiner* — Christopher M Raabe
(74) *Attorney, Agent, or Firm* — Reising Ethington, P.C.

(57) ABSTRACT

A spark plug suppressor and a method of producing a spark plug suppressor from a suppressor precursor liquid that may be cured at a temperature below 300° C. The spark plug suppressor may include particles or grains dispersed in a matrix of electrically conducting material, electrically semi-conducting material, or electrically non-conducting material. The suppressor may include a conductive glass seal component and a resistive suppressor component. The resistive suppressor component may be at least partially embedded in the glass seal component, and the glass seal component may seal a center electrode of the spark plug, a terminal of the spark plug, or both the center electrode and the terminal.

20 Claims, 2 Drawing Sheets

(56) References Cited

U.S. PATENT DOCUMENTS

Figure 1:
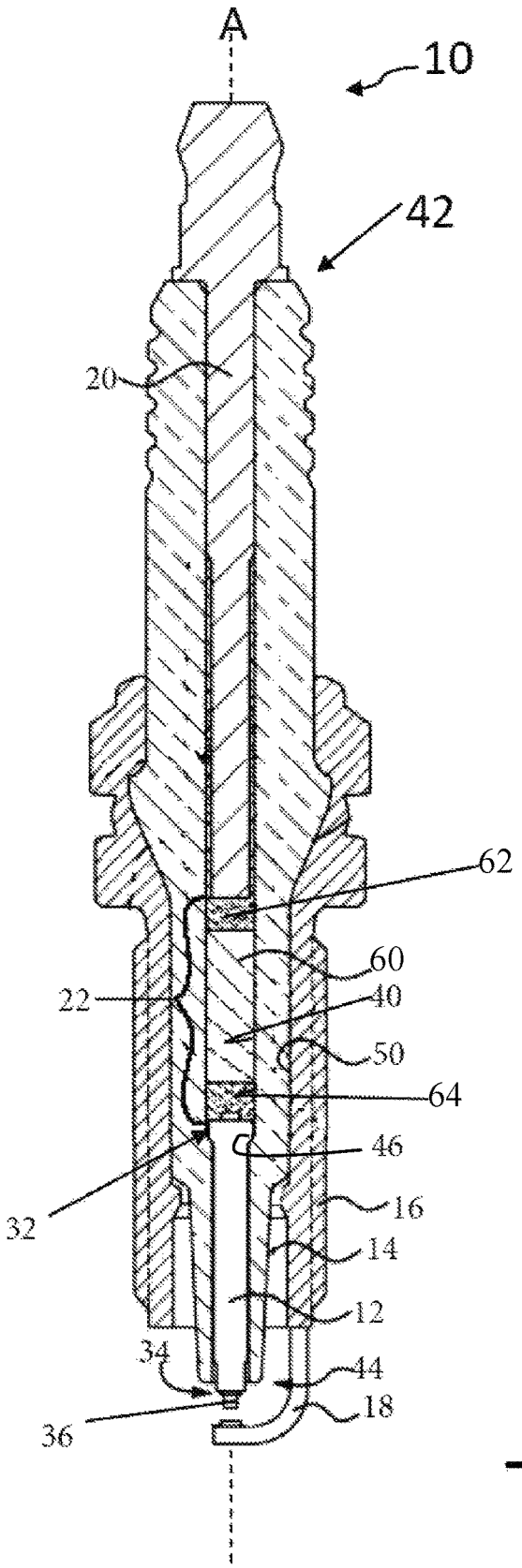

| | | | | |
|---|---|---|---|---|
| 5,304,894 | A | 4/1994 | Stimson | |
| 6,274,971 | B1 * | 8/2001 | Sugimoto | C03C 8/04 313/143 |
| 6,320,317 | B1 | 11/2001 | Keller | |
| 6,583,537 | B1 * | 6/2003 | Honda | H01T 13/41 313/135 |
| 8,633,640 | B2 | 1/2014 | Kyuno | |
| 8,970,098 | B1 | 3/2015 | Saji | |
| 2003/0051341 | A1 * | 3/2003 | Nishikawa | H01T 21/02 29/888.01 |
| 2005/0242694 | A1 | 11/2005 | Honda | |
| 2006/0076865 | A1 | 4/2006 | Shibata | |
| 2007/0290590 | A1 | 12/2007 | Hoffman | |
| 2011/0133626 | A1 | 6/2011 | Shibata | |
| 2012/0306345 | A1 | 12/2012 | Zheng | |
| 2015/0047880 | A1 | 2/2015 | Takaoka | |
| 2015/0214698 | A1 | 7/2015 | Moenkemoeller | |

* cited by examiner

SPARK PLUG WITH A SUPPRESSOR THAT IS FORMED AT LOW TEMPERATURE

REFERENCE TO RELATED APPLICATIONS

This application claims the benefit of U.S. Provisional Application No. 62/367,319 filed Jul. 27, 2016, the contents of which are hereby incorporated by reference in their entirety.

FIELD

The invention generally relates to spark plug suppressors and methods for making spark plug suppressors.

BACKGROUND

Spark plug suppressors can help suppress or reduce electromagnetic interference (EMI) and/or radio frequency interference (RFI), which may be by-products of an ignition spark when the spark plug is used in an internal combustion engine. The EMI and/or RFI may interact with engine control systems and/or other on-board electronic devices, so reducing the EMI and/or RFI may be desirable in some instances. Additionally, spark plug suppressors may help seal one or more spark plug components such as the center electrode, terminal, or both within an axial bore of the insulator.

SUMMARY

According to one embodiment, there is provided a spark plug comprising a metallic shell having an axial bore, an insulator having an axial bore and being disposed at least partially within the axial bore of the metallic shell, a center electrode being disposed at least partially within the axial bore of the insulator, a ground electrode being attached to the metallic shell, and a suppressor being arranged within the axial bore of the insulator. The suppressor is formed from a suppressor precursor liquid, and the suppressor includes particles or grains dispersed into a matrix of electrically conducting material, electrically semiconducting material, or electrically non-conducting material.

According to another embodiment, there is provided a spark plug comprising a metallic shell having an axial bore, an insulator having an axial bore and being disposed at least partially within the axial bore of the metallic shell, a center electrode being disposed at least partially within the axial bore of the insulator, a terminal being disposed at least partially within the axial bore of the insulator, a ground electrode being attached to the metallic shell, and a suppressor being arranged within the axial bore of the insulator. The suppressor includes a conductive glass seal component and a resistive suppressor component. The resistive suppressor component is at least partially embedded in the glass seal component and the glass seal component seals the center electrode, the terminal, or both the center electrode and the terminal. The resistive suppressor component is formed from a suppressor precursor liquid, and the suppressor precursor liquid includes precursor constituents in the form of electrically conducting particles, electrically semiconducting particles, or electrically non-conducting particles. The precursor constituents are mixed in a volatile organic compound (VOC) to form the suppressor precursor liquid. The resistive suppressor component includes the precursor constituents dispersed into a matrix of electrically conducting material, electrically semiconducting material, or electrically non-conducting material.

According to another embodiment, there is provided a method of forming a suppressor within an axial bore of a spark plug insulator. The method comprises the steps of preparing a suppressor precursor liquid, adding the suppressor precursor liquid into the axial bore of the spark plug insulator, and curing the suppressor precursor liquid at a temperature below 300° C.

DRAWINGS

Figure 2:
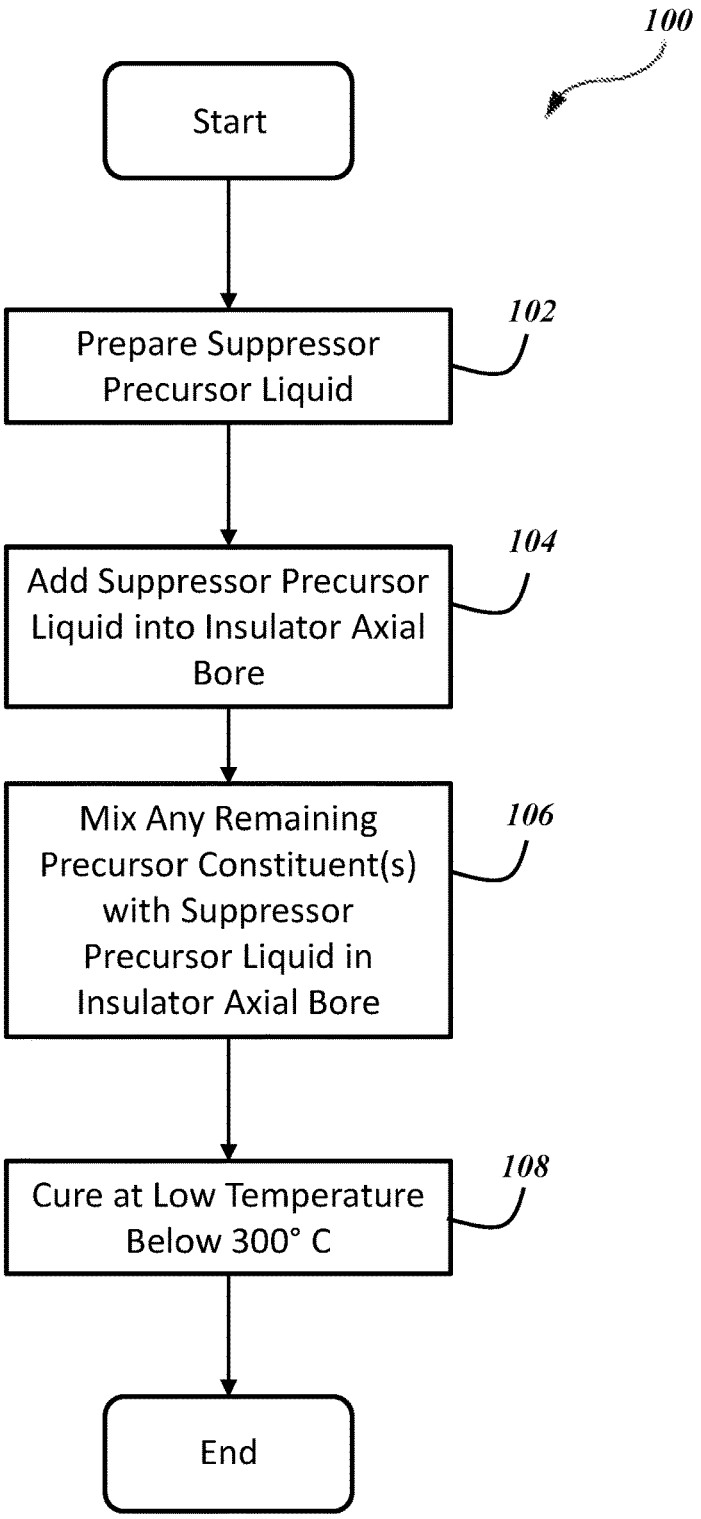

Preferred exemplary embodiments will hereinafter be described in conjunction with the appended drawings, wherein like designations denote like elements, and wherein:

FIG. 1 is a cross-sectional view of a spark plug with an exemplary spark plug suppressor; and FIG. 2 is a flow chart depicting an exemplary method for forming the spark plug suppressor of FIG. 1.

DESCRIPTION

The present application describes a suppressor for a spark plug and a method of making the same, where the suppressor is designed to reduce the amount of electromagnetic interference (EMI) produced by the spark plug when it is used in an engine. More specifically, a suppressor or suppressor seal or noise suppressor, as it is sometimes called, minimizes EMI by acting as a resistor within an insulator bore and absorbing interfering electromagnetic waves.

According to one embodiment of forming the present suppressor, one or more precursor constituents are prepared into a liquid state, are poured, injected, or otherwise added into an axial bore of a spark plug insulator, are mixed with any remaining precursor constituents, and are then cured and solidified at a relatively low curing temperature (e.g., below 300° Celsius).

Unlike traditional methods that utilize powder and other non-liquid precursor constituents, the present method may enjoy certain manufacturing benefits. One potential benefit of the present method pertains to better consistency and uniformity among different suppressor batches, as well as within a particular suppressor batch. Liquid precursors can use higher shear to achieve better homogenization of the constituents as opposed to a glass powder mixture, and a liquid can also be metered and fed into the bore of an insulator with good accuracy. Furthermore, the precursor constituents can be prepared outside of the spark plug insulator in large batches, such as in a liquid slurry or paste, further enabling the production of larger uniform batch quantities. Another potential benefit is that a liquid material does not generate the same dust as a powder. This improves manufacturing conditions and also reduces the risk of cross contamination during production. Also, the method described herein utilizes a relatively low temperature curing process (e.g., below 300° C.) which in turn reduces energy costs and expensive manufacturing equipment. Because the precursor constituents are already prepared in a liquid form and therefore do not need to be melted before being hardened, traditional melting and/or firing steps can be eliminated.

The spark plug suppressor and corresponding manufacturing method set forth in this description can be used with a wide variety of spark plugs and other ignition devices including automotive spark plugs, diesel glow plugs, industrial plugs, aviation igniters, or any other device that is used to ignite an air/fuel mixture in an engine. This includes spark plugs used in automotive internal combustion engines equipped to provide gasoline direct injection (GDI), turbo- or super-charged engines, engines operating under lean burning strategies, engines operating under fuel efficient strategies, engines operating under reduced emission strategies, or a combination of these. As used herein, the terms axial, radial, and circumferential describe directions with respect to the generally cylindrical shape of the spark plug of FIG. 1 and refer to a center axis A of the spark plug 10, unless otherwise specified.

Referring to FIG. 1, a spark plug 10 includes a center electrode (CE) base or body 12, an insulator 14, a metallic shell 16, a ground electrode (GE) base or body 18, a terminal 20, and a suppressor 22.

The CE body 12 is generally disposed within an axial bore 40 of the insulator 14, and has a sealed end portion 32 and a firing end portion 34 exposed outside of the insulator at a firing end of the spark plug 10. The sealed end portion 32 is typically enlarged, in terms of its diameter, so that it rests on an interior shoulder 46 formed in the insulator bore 40. The firing end portion 34 is located on the opposite axial end of the CE body 12 and usually protrudes out of the insulator bore 40 so that it is exposed to a spark gap, as shown. In one example, the CE body 12 is made of a nickel-based alloy material that serves as an external or cladding portion of the body, and includes a copper or copper-based alloy material that serves as an internal core of the body (not shown) for managing heat within the CE body. Of course, other materials and configurations are possible including a non-copper cored CE body made of a single material. The CE body 12 may or may not include a separate firing tip, pad or piece 36 made of one or more precious metal-based alloys, such as those made of platinum, iridium, ruthenium, palladium, rhodium or a combination thereof. The aforementioned features and possibilities apply to the GE body 18 as well; thus a separate description has been omitted.

The insulator 14 is generally disposed within an axial bore 50 of the metallic shell 16, and has a terminal portion 42 and a nose portion 44 exposed outside of the shell at the firing end of the spark plug 10. Along the axial length of the insulator 14, between the terminal portion 42 and the nose portion 44, the insulator axial bore 40 may include different sections or segments of varying internal diameter. For example, a first interior shoulder 46 is formed so that the enlarged sealed end portion 32 of the CE body can rest upon and be sealed against the insulator. The insulator bore 40 may include other interior shoulders, tapers and configurations and does not have to be a straight cylindrical bore, as shown in sections of FIG. 1. The insulator 14 is made of a rigid electrically insulating material, such as a ceramic material, that electrically isolates the CE body 12 from the metallic shell 16.

The metallic shell 16 surrounds portions of the insulator 14 and includes at least one ground electrode attached at the front end of the spark plug. While the ground electrode 18 is depicted in the traditional J-gap configuration, it will be appreciated that spark plug 10 may have a single electrode, multiple ground electrodes, or an annular ground electrode, or any other known configuration can be substituted depending upon the intended application of the spark plug.

The suppressor 22 is located within the insulator axial bore 40. The suppressor 22 provides an electrical path through the center wire assembly from the terminal 20 to the center electrode base 12 at the sealed end portion 32. Spark plugs having such features are sometimes termed resistor spark plugs or suppressor spark plugs. The suppressor 22 serves to suppress or reduce electromagnetic energy, including electromagnetic interference (EMI) and radio frequency interference (RFI), caused as a by-product of an ignition spark. EMI and RFI can affect engine control systems and other on-board electronic devices, so it is desirable to reduce these types of interferences. Suppressors are also utilized to combat the high temperatures and pressures exerted on a spark plug when operating in the combustion chamber. The suppressor component 22 acts as a strong seal to hold the components within the insulator bore 40, such as the center electrode 12, while also minimizing gas leakage through the longitudinal length of the insulator.

The suppressor 22 may be a single, homogeneous suppressor component, or it may be segmented into separate suppressor components, such as conductive and/or resistive segment(s). FIG. 1 illustrates a segmented exemplary design wherein there are several distinctive suppressor components and/or layers stacked axially within the insulator axial bore 40. A resistive suppressor component is designated as element 60, a first conductive glass seal component is designated as element 62, and a second conductive glass seal component is designated as element 64. The resistive suppressor component 60 may have a resistivity between 1 kΩ and 15 kΩ, for example. In such design, the conductive layers 62, 64 provide a transition between the metallic terminal 20 and the resistive suppressor component 60 and the center electrode body 12, as component 60 may not seal well to metallic pieces 20 and 12. The suppressor component 22 may form a hermetic seal in the internal bore 40 of the insulator and bond to the lower end of terminal 20 and/or the sealed end portion 32 of the CE. With respect to FIG. 1, this bonding is found between glass seal component 62 and terminal 20 and/or between glass seal component 64 and sealed end portion 32. It will be appreciated that the configuration and distributions in FIG. 1 of resistive and conductive segments is exemplary, and suppressor component 22 may exist in a variety of different resistive and conductive configurations and distributions. For instance, suppressor 22 may include different numbers and/or sequences of conductive and resistive components, and is not limited to one-part or three-part embodiments. Moreover, suppressor component 22 may be used in conjunction with a variety of center wire components, including those elements that are known in the art but not illustrated in FIG. 1, such as a spring or push pin, to cite a few examples.

Precursor constituents for the suppressor component 22 may include electrically conductive particles or grains, electrically semiconductive particles or grains, electrically non-conductive particles or grains, or any combination of these. Precursor constituents may be prepared through the addition of solvents, such as volatile organic compounds (VOCs). Examples of electrically non-conductive particles may include one or more of: alumina, silica, zirconia, titania, silicate glass, alumino-silicate glass, and boro-silicate glass. Examples of electrically conductive particles or grains may include one or more of: carbon, copper, molybdenum, nickel, silicon, titanium, tungsten, or any of these compounded with oxygen, carbon or other suitable element (such as tungsten oxide, silicon carbide and moly-disilicide). Other appropriate electrically conductive, semiconductive, and/or nonconductive materials may include geopolymers (also known as Inorganic aluminosilicate polymers and consisting of a polymeric Si—O—Al framework). In the segmented or multi-component suppressor design, these precursor constituents may be used to form the resistive elements and/or the conductive elements, but are particularly suitable for forming the resistive elements.

According to a first non-limiting example, a dry powder mixture may be prepared having approximately 85-90 wt % calcined kaolin with particle sizes of less than about 45 microns, 5-15 wt % calcium hydroxide, and less than 1 wt % carbon black. A solution is prepared by mixing 5-15% of a 30% sodium hydroxide solution and 85-90% "N brand" sodium silicate. The solution and the powder mixture are blended in a ratio of between 1:1 and 1:3 to produce a "suppressor precursor liquid". It will be understood by one skilled in the art that the amount of carbon or graphite can be varied in order to produce the desired electrical resistance of the seal. According to a second non-limiting example, a powder may be prepared having calcined kaolin and less than 0.5% carbon black. A liquid is then prepared, as in the first example, but substituting Urea for sodium hydroxide. The two can be mixed in a ratio between 1:1 and 1:3. The ratio of powder to liquid can control the working time of the mixture its viscosity and/or other characteristics. A larger ratio of the liquid will result in a shorter working time before the viscosity increases out of the usable range. Again, the aforementioned examples are non-limiting and simply provide some possibilities in terms of the suppressor component; other possibilities certainly exist.

Turning next to FIG. 2, an exemplary method of forming a spark plug suppressor 22 is now described in more detail. This method is applicable to any or all of suppressor subcomponents 60, 62 and/or 64.

According to a method as depicted in FIG. 2, the suppressor 22 is formed from a series of steps. Beginning with step 102, one or more constituents are joined, mixed or otherwise introduced to form a suppressor precursor liquid. "Suppressor precursor liquid," as used herein, means a liquid or semi-liquid mixture of suppressor precursor material and may be provided in the form of a liquid, paste, slurry or other substance having a similar consistency. The suppressor precursor liquid is made of at least one precursor constituent, which may be blended, mixed and/or prepared before being inserted into the insulator axial bore 40. Where more than one precursor constituent exists, all of the precursor constituents may be blended or mixed together prior to being introduced into the insulator axial bore 40, all of the precursor constituents may be prepared separately and blended or mixed together after being added to the insulator axial bore 40 (in situ), or a mix of the two options may be used.

In step 104, the suppressor precursor liquid(s) are added or introduced into the axial bore of the insulator. Adding may be done by pouring, injecting, metering, or any other way of transferring the suppressor precursor liquid into the insulator axial bore 40. In the example where the components of the suppressor precursor liquid are blended or mixed before insertion into bore 40, the consistency of the precursor liquid may be somewhat akin to a viscous paste. For instance, the precursor liquid may have a viscosity of approximately 5 to 10 Pascal seconds, but other viscosities may be used instead. Step 104 may inject the somewhat viscous suppressor precursor liquid using any suitable method or technique that cleanly introduces the substance into the insulator axial bore, such as by using a syringe, funnel or dropper, to cite just a few of the possibilities. In the example where the components are blended within the axial bore 40 (in situ), the suppressor precursor liquid may be slightly less viscous, in which case, step 104 may meter out the liquid using the same or other techniques.

In some embodiments, not all precursor constituents were mixed together in step 102. In such cases, the remaining precursor constituents may be added to the suppressor precursor liquid in the insulator bore in step 106. For example, as a modification to the first and second non-limiting examples described above, the powder could be mixed with water to form a precursor paste, with the liquid solution added later, just before use. Other embodiments are certainly possible.

In step 108, the suppressor constituents are cured at a relatively low curing temperature below 300° C. to form a solid suppressor component 22. Once cured, the suppressor component 22 may form a hermetic seal in the internal bore 40 and bond to the lower end of terminal 42 and/or the sealed end portion 32 of the CE.

There are a variety of ways to cure the suppressor seal constituent(s) at a relatively low curing temperature. A few of the non-limiting exemplary embodiments are discussed herein. In one embodiment, the suppressor component 22 cures because of the reaction of one or more alkali silicates with a powder from the group comprising alumina, silica, silicates and alumino-silicates. This is commonly referred to as the alkali-silica reaction (ASR). In other embodiments, hydrolysis, condensation and/or polymerization methods are used. A sol-gel reaction, for example, may utilize all three. The chemical reaction that causes the suppressor component 22 to cure in a sol-gel reaction is based upon the hydrolysis and condensation of silicon alkoxide. The hydrolysis (a) and condensation (b) of silicon alkoxide is illustrated below:

(a) $Si—OR+H_2O \rightarrow Si—OH+ROH$ (b) $Si—OH+Si—OR \rightarrow Si—O—Si+ROH$ $Si—OH+Si—OH \rightarrow Si—O—Si+H_2O$ Although the sol-gel condensation step may require some input of energy and/or a drying step may follow the condensation step in order to solidify the gel into a lattice or matrix, the input is well below the energy required in traditional firing methods. For instance, fired in suppressor seals (FISS) usually have to be melted at temperatures of about 875° C.-900° C. in order to form the suppressors in the insulator bore. This process is much different than that described here, which does not require such high temperature furnaces, etc.

Another chemical reaction that may be used in the curing of the suppressor component 22 is the hydrolysis of ethyl silicate, tetra-ethyl ortho-silicate or other alkyl silicates. For example, and similar to above, $Si(OC_2H_2)+H_2O \rightarrow Si(OH)_4+C_2H_3OH$. This may occur as part of the sol-gel process.

It is also possible to use a thermoset ceramic or polymer material, such as a one-part epoxy resin, which stays as a liquid precursor until some input energy (usually heat, but could also be light, such as UV light) is added to initiate the reaction. It is also possible to use a two-part epoxy, where one part is a liquid until it is mixed with an activator to cause a polymerization reaction. Skilled artisans will appreciate that one part materials must remain protected from the initiator energy or they may solidify prematurely, whereas two part materials are each stable when kept separate, but once mixed, will remain a liquid until an initiator is added, whether heat or UV or other. Two part epoxy materials generally begin polymerizing as soon as an "activator" solution is added to the base, and can take from a few seconds to several hours. Sometimes these are assisted by the addition of heat, but are usually below 100° C., as too much heat can damage the polymerization reaction. Oftentimes curing will happen without any assistance once the activator is added. Other suitable curing methods and techniques are certainly possible.

The electrically conductive, semiconductive, and/or non-conductive materials may form a matrix or lattice once cured. It is possible to have electrically conducting or electrically semiconducting particles or grains dispersed into a matrix of non-conducting material. It is possible to have electrically non-conducting particles or grains dispersed into a matrix of conducting or semi-conducting material. It is also possible to have electrically conducting or electrically semiconducting particles or grains dispersed into a matrix of electrically conducting or semiconducting material. According to one example, a matrix is formed containing dispersed particles or grains of conducting or semiconducting material, where the dispersed particles are in contact with one another in order to form an electrically conductive pathway. The extent to which the particles form electrically conductive pathways controls the overall electrical resistance of the suppressor component.

The desired electrical resistivity of the suppressor component 22 is controlled by regulating the precursor constituents in the matrix. The suppressor component 22 may have an electrical resistance between 1000 and 15000 Ohms.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being disposed at least partially within the axial bore of the metallic shell;

a center electrode being disposed at least partially within the axial bore of the insulator;

a ground electrode being attached to the metallic shell; and a suppressor being arranged within the axial bore of the insulator, wherein the suppressor is formed from a suppressor precursor liquid that is cured at a temperature less than 300° C. so that the cured suppressor precursor liquid includes a network of particles or grains dispersed into a matrix of electrically conducting material, electrically semiconducting material, or electrically non-conducting material.

2. The spark plug of claim 1, wherein the suppressor includes first and second conductive glass seal components and a resistive suppressor component, wherein the resistive suppressor component is at least partially embedded between the first and second glass seal components and the first and second glass seal components seal the center electrode, a terminal, or both the center electrode and the terminal.

3. The spark plug of claim 1, wherein the particles or grains are electrically conducting or electrically semiconducting and include one or more of: carbon, copper, molybdenum, nickel, silicon, titanium, tungsten, or compounds containing carbon, copper, molybdenum, nickel, silicon, titanium, or tungsten.

4. The spark plug of claim 3, wherein the particles or grains are in contact with one another in order to form an electrically conductive pathway.

5. The spark plug of claim 3, wherein the matrix is comprised of an electrically conducting material or an electrically semiconducting material.

6. The spark plug of claim 3, wherein the matrix is comprised of an electrically non-conducting material.

7. The spark plug of claim 1, wherein the particles or grains are non-conductive and the matrix is comprised of an electrically conducting material or an electrically semiconducting material.

8. The spark plug of claim 1, wherein the network includes a network of siloxane (Si—O—Si) bonds resulting from a polymerization of the suppressor precursor liquid.

9. The spark plug of claim 1, wherein the matrix of electrically conducting material, electrically semiconducting material, or electrically non-conducting material includes a geopolymer.

10. The spark plug of claim 9, wherein the matrix includes a polymeric aluminosilicate (Si—O—Al) framework.

11. The spark plug of claim 1, wherein the suppressor has a resistance between 1000 ohms and 15000 ohms.

12. A spark plug, comprising:

a metallic shell having an axial bore;

an insulator having an axial bore and being disposed at least partially within the axial bore of the metallic shell;

a center electrode being disposed at least partially within the axial bore of the insulator;

a ground electrode being attached to the metallic shell; and a suppressor being arranged within the axial bore of the insulator, wherein the suppressor is formed from a suppressor precursor liquid, and the suppressor includes particles or grains dispersed into a matrix of electrically conducting material, electrically semiconducting material, or electrically non-conducting material, wherein the particles or grains include approximately 89-90 wt % calcined kaolin, 9-10 wt % calcium hydroxide, and less than 1 wt % carbon black.

13. The spark plug of claim 12, wherein the particle size of the calcined kaolin is less than about 45 microns.

14. A spark plug, comprising:

a metallic shell having an axial bore;

an insulator having an axial bore and being disposed at least partially within the axial bore of the metallic shell;

a center electrode being disposed at least partially within the axial bore of the insulator;

a terminal being disposed at least partially within the axial bore of the insulator;

a ground electrode being attached to the metallic shell; and a suppressor being arranged within the axial bore of the insulator between the center electrode and the terminal, wherein the suppressor includes a conductive glass seal component and a resistive suppressor component, wherein the resistive suppressor component is adjacent to the glass seal component and the glass seal component seals the center electrode, the terminal, or both the center electrode and the terminal, wherein the resistive suppressor component is formed from a suppressor precursor liquid that is cured at a temperature less than 300° C., the suppressor precursor liquid including precursor constituents in the form of electrically conducting particles, electrically semiconducting particles, or electrically non-conducting particles, wherein the precursor constituents are mixed in a volatile organic compound (VOC) to form the suppressor precursor liquid, wherein the resistive suppressor component includes a network of the precursor constituents dispersed into a matrix of electrically conducting material, electrically semiconducting material, or electrically non-conducting material.

15. A method of forming the suppressor of the spark plug of claim 1 within the axial bore of the spark plug insulator, the method comprising the steps of:

preparing the suppressor precursor liquid by blending a solution and a powder mixture;

adding the suppressor precursor liquid into the axial bore of the spark plug insulator; and curing the suppressor precursor liquid at a temperature below 300° C.

16. The method of claim 15, wherein additional precursor constituents are added to the suppressor precursor liquid in the insulator axial bore and mixed in situ before curing.

17. The method of claim 15, wherein the step of adding the suppressor precursor liquid includes metering and injecting the precursor liquid into the axial bore of the spark plug insulator.

18. The method of claim 15, wherein the ratio of the solution to the powder mixture is between 1:1 and 1:3, inclusive.

19. The method of claim 15, wherein the solution includes urea or sodium hydroxide mixed with sodium silicate.

20. The method of claim 15, wherein the curing step includes a hydrolysis, condensation, and polymerization sol-gel reaction method.

* * * * *